US008005253B2

(12) United States Patent
Funahashi

(10) Patent No.: US 8,005,253 B2
(45) Date of Patent: Aug. 23, 2011

(54) SPEAKER

(75) Inventor: Osamu Funahashi, Mei (JP)

(73) Assignee: Panasonic Corporation, Osaka (JP)

( * ) Notice: Subject to any disclaimer, the term of this patent is extended or adjusted under 35 U.S.C. 154(b) by 1077 days.

(21) Appl. No.: 11/794,953

(22) PCT Filed: Jan. 15, 2007

(86) PCT No.: PCT/JP2007/050381

§ 371 (c)(1),
(2), (4) Date: Jul. 10, 2007

(87) PCT Pub. No.: WO2007/083582

PCT Pub. Date: Jul. 26, 2007

(65) Prior Publication Data

US 2009/0123019 A1 May 14, 2009

(30) Foreign Application Priority Data

Jan. 17, 2006 (JP) ..... 2006-008445

(51) Int. Cl.
*H04R 25/00* (2006.01)

(52) U.S. Cl. ..... 381/403; 381/398; 381/404

(58) Field of Classification Search ..... 381/396, 381/398, 403, 404, 405, 423, 432, 433; 181/171, 181/172

See application file for complete search history.

(56) References Cited

U.S. PATENT DOCUMENTS

| | | | | |
|---|---|---|---|---|
| 5,847,333 | A * | 12/1998 | D'Hoogh | 181/171 |
| 6,031,925 | A * | 2/2000 | Shteyn | 381/401 |
| 6,236,733 | B1 * | 5/2001 | Kato et al. | 381/423 |
| 6,448,375 | B1 | 9/2002 | Hutt | |
| 6,655,495 | B2 | 12/2003 | Kuze et al. | |
| 7,209,570 | B2 | 4/2007 | Funahashi et al. | |
| 2003/0079936 | A1 | 5/2003 | Kuze et al. | |
| 2003/0185415 | A1 * | 10/2003 | Funahashi et al. | 381/398 |

FOREIGN PATENT DOCUMENTS

| | | | |
|---|---|---|---|
| EP | 1 324 632 | A1 | 7/2003 |
| JP | 02-133097 | | 11/1990 |
| JP | 2003-199192 | A | 7/2003 |
| JP | 2004-007332 | | 1/2004 |
| KR | 2003-0022376 | A | 3/2003 |

OTHER PUBLICATIONS

Korean Office Action issued in Korean Patent Application No. KR 10-2007-7014856 dated on Nov. 25, 2008.
Chinese Office Action issued in Chinese Patent Application No. 200780000083.2, dated Jan. 10, 2011.
European Search Report issued in European Patent Application No. 077067221.1-1224, mailed Mar. 10, 2011.

* cited by examiner

*Primary Examiner* — Huyen D Le
(74) *Attorney, Agent, or Firm* — McDermott Will & Emery LLP

(57) ABSTRACT

The invention is intended to enhance the driving efficiency in a speaker being less in distortion. In order to achieve the purpose, there is provided a damper disposed rather closer to a magnetic circuit than the diaphragm, of which the inner rim is connected to a voice coil body, and the outer rim of the damper is connected to the frame via the second edge. The second edge is protruded toward the diaphragm or the opposite side thereof. The damper has such a structure that the first protrusion protruding toward the diaphragm and the second protrusion protruding in a direction opposite to the first protrusion are alternately repeated in a plurality of times, and the first protrusion and the second protrusion are different in size from each other. The smaller protrusion out of the first and second protrusions is same in protruding direction as the second edge.

9 Claims, 2 Drawing Sheets

FIG. 3 *Prior Art*

SPEAKER

RELATED APPLICATIONS

This application is the U.S. National Phase under 35 U.S.C. §371 of International Application No. PCT/JP2007/050381, filed on Jan. 15, 2007, which in turn claims the benefit of Japanese Application No. 2006-008445, filed on Jan. 17, 2006, the disclosures of which applications are incorporated by reference herein.

FIELD OF THE INVENTION

The present invention relates to a speaker.

BACKGROUND ART

FIG. 3 is a partial sectional view of a conventional speaker. As shown in FIG. 3, the conventional speaker is configured in that voice coil body 2A movably disposed in magnetic circuit 1A is connected to the inner rim of diaphragm 3A, and the outer rim of diaphragm 3A is connected to frame 5A via edge 4A, and further, the rear face of diaphragm 3A is connected to frame 5A via suspension holder 6A and edge 7A. Also, the protruding shapes of edge 4A and edge 7A are opposed to each other in direction to make the vertical excursion of diaphragm 3A vertically symmetrical, thereby reducing distortion in the speaker.

As the preceding technical document information with respect to the invention of the present application, for example, Patent Document 1 is commonly known.

Since the speaker shown in FIG. 3 uses suspension holder 6A which supports diaphragm 3A, it is increased in weight, but it will not become a big problem as a woofer that applies a great output. However, as a mid-range and a full-range speaker, the heavy weight becomes a problem of being low in driving efficiency.

[Patent Document 1] Japanese Laid-open Patent 2004-7332

DISCLOSURE OF THE INVENTION

The present invention is intended to enhance the driving efficiency in a speaker being less in distortion.

In order to achieve the purpose, the present invention comprises a frame, a magnetic circuit supported by the frame, a voice coil body movably disposed against magnetic gap in the magnetic circuit, a diaphragm with its outer rim connected to the frame via a first edge and its inner rim connected to the voice coil body, and a damper disposed rather closer to the magnetic circuit than the diaphragm, of which the inner rim is connected to the voice coil body, wherein the outer rim of the damper is connected to the frame via a second edge, and the second edge is protruded toward the diaphragm or the opposite side thereof. The damper has such a structure that a first protrusion protruding toward the diaphragm and a second protrusion protruding in a direction opposite to the first protrusion are alternately repeated in a plurality of times, and the first protrusion and the second protrusion are different in size, and the smaller protrusion out of the first and second protrusions is same in protruding direction as that of the second edge.

In this configuration, speaker distortion can be suppressed, and it is possible to enhance the driving efficiency by decreasing the weight even as a mid-range and a full-range speaker.

BRIEF DESCRIPTION OF THE DRAWINGS

FIG. 3 is a partial sectional view of a conventional speaker.

DESCRIPTION OF THE REFERENCE NUMERALS AND SIGNS

Figure 1:
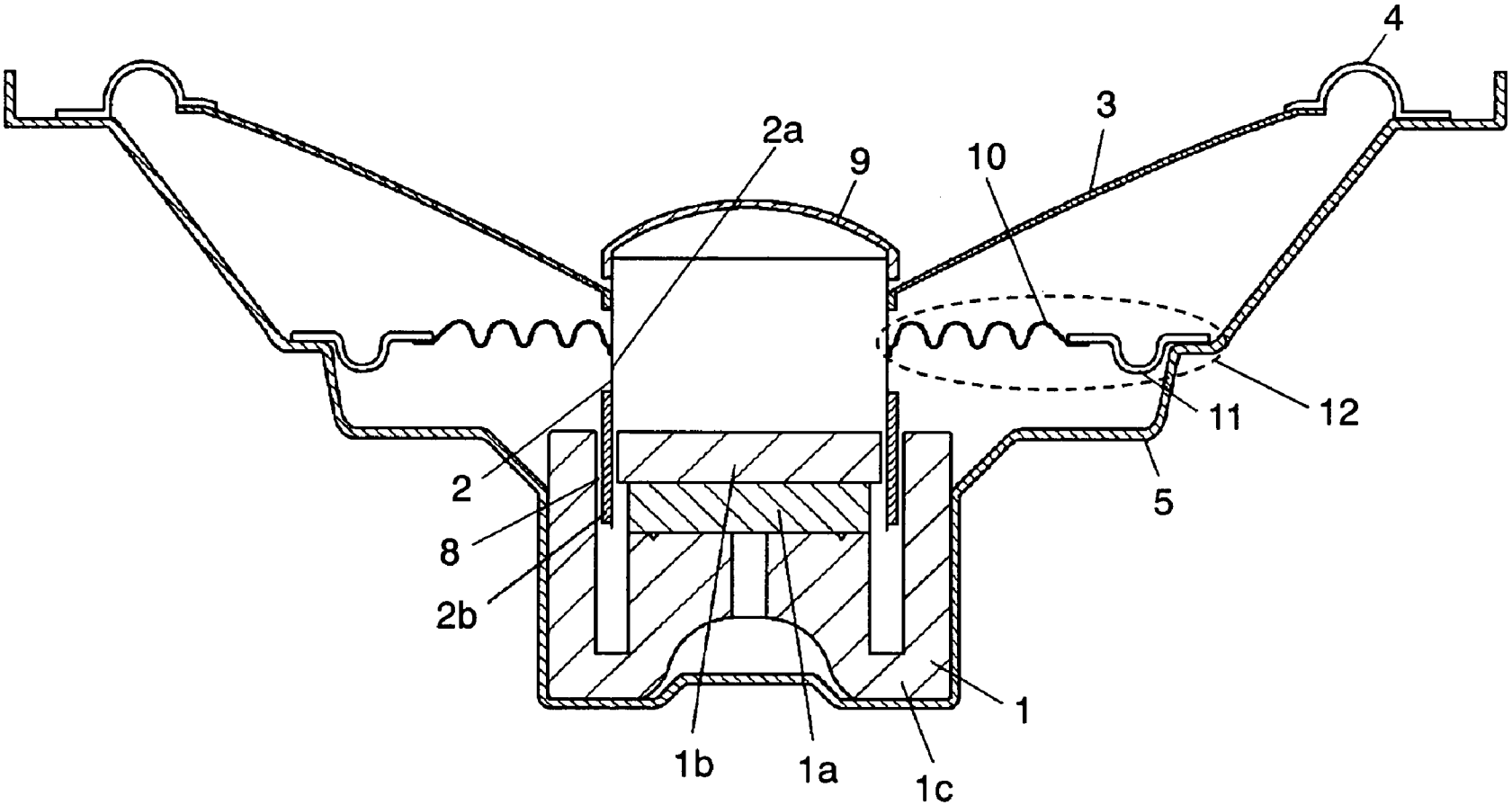
FIG. 1 is a sectional view of a speaker in one preferred embodiment of the present invention.

1 Magnetic circuit
2 Voice coil body
3 Diaphragm
4 First edge
5 Frame
8 Magnetic gap
10 Damper
10*a* First protrusion
10*b* Second protrusion
11 Second edge
12 Combination

DETAILED DESCRIPTION OF THE PREFERRED EMBODIMENTS

One preferred embodiment of the present invention will be described in the following with reference to the drawings.

FIG. 1 is a sectional view of a speaker in one preferred embodiment of the present invention. Magnetic circuit 1 disposed at the bottom center of cone-shaped frame 5 is formed of disk-like magnet 1*a*, disk-like plate 1*b*, and cylindrical yoke 1*c* which are assembled and bonded. Cylindrical magnetic gap 8 opening upward in magnetic circuit 1 is formed between the inner wall of yoke 1*c* and the outer wall of plate 1*b*. Also, voice coil body 2 is configured in that coil 2*b* is wound on the outer wall of cylindrical body 2*a*, which is vertically movable against magnetic gap 8, and thereby, thin saucer-like diaphragm 3 connected to the upper section of the outer wall of voice coil body 2 can be vibrated. The upper end portion of voice coil body 2 is provided with dust cap 9 for the purpose of dust prevention.

Diaphragm 3 is a portion that serves as a sound source of the speaker, for which pulp and resin fulfilling the requirements for both high stiffness and internal loss are used as main materials, and the outer rim thereof is connected to the opening end of frame 5 via first edge 4 protruding upward, while the inner rim is fixed by bond 3*a* on the outer wall of body 2*a* of voice coil body 2. First edge 4 is formed from a material such as urethane, foamed rubber, SBR rubber, and cloth so that a moving load will not be given to diaphragm 3.

Figure 2:
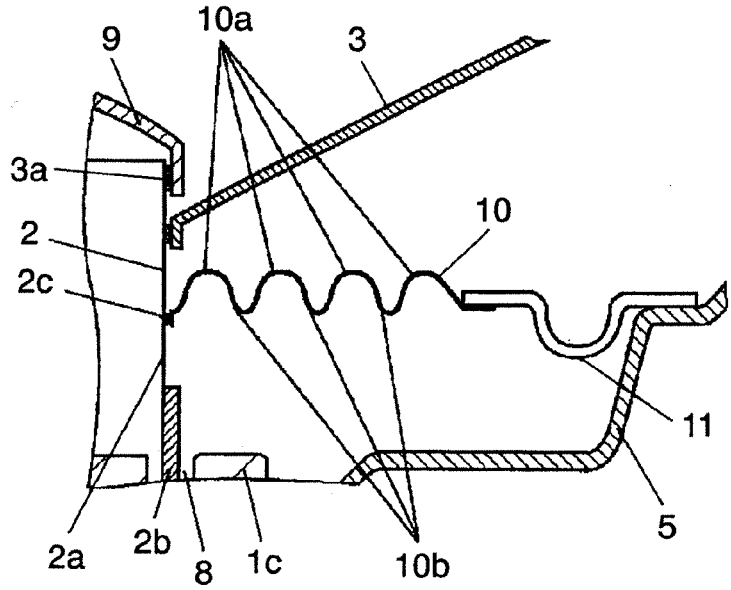
FIG. 2 is an enlarged sectional view of an essential part of a speaker in one preferred embodiment of the present invention.
Figure 2:
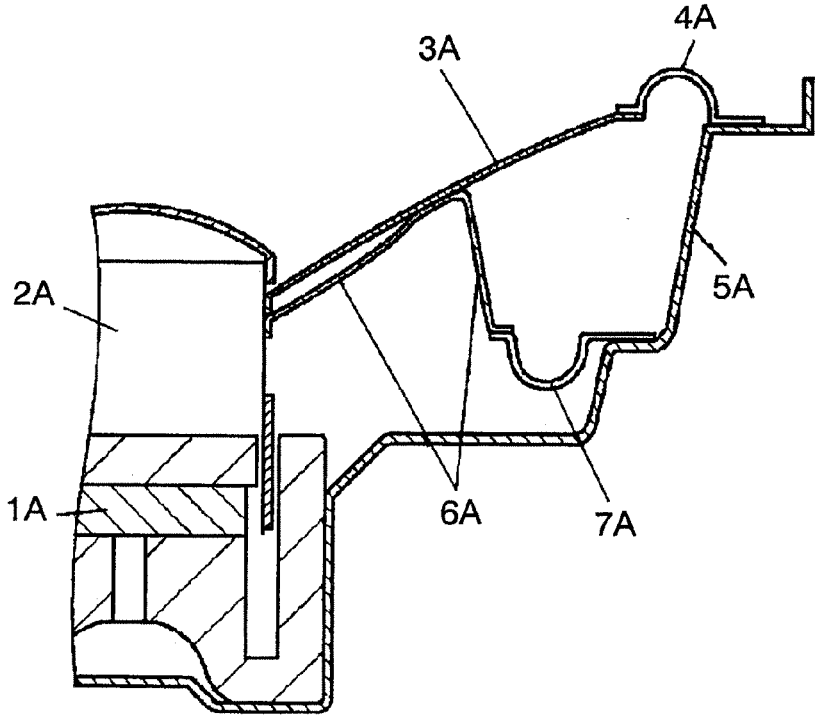

FIG. 2 is an enlarged sectional view of an essential portion of the speaker in one preferred embodiment of the present invention.

As shown in FIG. 1 and FIG. 2, damper 10 is fixed by bond 2*c* in a position such that the inner rim thereof is rather closer to magnetic circuit 1 than the fixed portion of diaphragm 3 at the outer wall of body 2*a* of voice coil body 2, and the outer rim is connected to frame 5 via second edge 11 that is different from damper 10. Damper 10 has a corrugated ring-like structure and is flexible against the movement of voice coil body 2, which is formed from a material such as urethane, foamed rubber, SBR rubber, and cloth so that a moving load will not be given to diaphragm 3 the same as for first edge 4 disposed on diaphragm 3.

Second edge 11 and damper 10 will be further described in the following. Firstly, second edge 11 is structurally protruded in a direction opposite to diaphragm 3 in this preferred embodiment. Also, damper 10 is structurally such that first protrusion 10*a* protruding toward diaphragm 3 and second protrusion 10*b* protruding in a direction opposite to first protrusion 10*a* are alternately repeated in a plurality of times. Further, first protrusion 10*a* and second protrusion 10*b* are different in size from each other, and in this preferred embodiment, first protrusion 10*a* is larger than second protrusion 10*b*.

Also, the protruding direction of second edge 11 is same as the protruding direction of second protrusion 10*b* that is smaller than first protrusion 10*a*, and thereby, speaker distortion can be suppressed. The reason for this will be described later.

In the above configuration, a voice signal is applied to coil 2*b* of voice coil body 2, then voice coil body 2 reacts with the magnetic field of magnetic gap 8 and moves in a vertical direction. Diaphragm 3 is vibrated due to the movement to emit a sound from the speaker. Particularly, since second edge 11 is disposed at the outer rim of damper 10, speaker distortion is suppressed, and further, the driving efficiency of the speaker is enhanced.

Conventionally, the inner and outer rims of damper 10 are connected to frame 5 and voice coil body 2, thereby suppressing rolling of voice coil body 2 in operation. In this preferred embodiment, to make easier to follow the movement of voice coil body 2, first protrusion 10*a* protruding toward diaphragm 3 and second protrusion 10*b* protruding in a direction opposite to first protrusion 10*a* are alternately repeated in a plurality of times, thereby providing the structure with elasticity.

Thus, damper 10 is a ring-like corrugated plate having a plurality of first protrusions 10*a* and second protrusions 10*b*. As a result, when voice coil body 2 is small in the excursion, damper 10 will not cause a great load to the movement of voice coil body 2, but the load is increased as the excursion of voice coil body 2 becomes larger.

Accordingly, in this preferred embodiment, the outer rim of damper 10 is connected to frame 5 via second edge 11. In this way, the excursion of voice coil body 2 is increased, a stress is applied to second edge 11 when the load of damper 10 becomes increased, and second edge 11 is elastically deformed in accordance with the stress.

As a result, even in case the excursion of voice coil body 2 becomes larger, damper 10 will hardly cause hindrance to the excursion, and it is possible to suppress lowering of the driving efficiency.

Also, in the present preferred embodiment, voice coil body 2 is vertically supported by two support members such as first edge 4 and combination 12 formed of damper 10 and second edge 11. And, in order to enhance the driving efficiency of diaphragm 3, first edge 4 is reduced in thickness to decrease its weight, and thereby, the total weight of diaphragm 3 and first edge 4 is reduced. In this way, it is structurally possible to enhance the driving efficiency of diaphragm 3.

However, when first edge 4 is reduced in thickness, the supporting strength for voice coil body 2 is lowered, and therefore, second edge 11 is made thicker than first edge 4, and thereby, the supporting strength for voice coil body 2 is prevented from lowering. As a result, Young's modulus of combination 12 formed of damper 10 and second edge 11 is greater (stiffer) than Young's modulus of first edge 4.

Due to the above configuration, voice coil body 2 is mainly supported by combination 12 formed of damper 10 and second edge 11. Accordingly, to suppress the distortion of up and down excursion of diaphragm 3, it is necessary to make the up and down loads of combination 12 formed of damper 10 and second edge 11 equal to each other as much as possible.

The shape of damper 10 in this preferred embodiment shown in FIG. 2 is discussed in the following.

In this preferred embodiment, first protrusion 10*a* protruding toward diaphragm 3 and second protrusion 10*b* protruding in a direction opposite to first protrusion 10*a* are alternately repeated in a plurality of times.

In such a shape, as a result of taking into account various characteristics, when first protrusion 10*a* is larger in size than second protrusion 10*b*, second edge 11 is protruded in the same direction as second protrusion 10*b* being small, specifically in a direction opposite to diaphragm 3. In this way, it is possible to obtain the following advantages.

That is, when second protrusion 10*b* is smaller than first protrusion 10*a*, damper 10 is easy to elastically deform toward diaphragm 3 and hard to elastically deform in a direction opposite to diaphragm 3.

In order to make up for the elasticity of damper 10 which is hard to elastically deform in a direction opposite to diaphragm 3, the protruding direction of second protrusion 10*b* is same as the protruding direction of second edge 11. That is, each of second protrusion 10*b* and second edge 11 is protruded in a direction opposite to diaphragm 3.

That is, since second edge 11, first protrusion 10*a*, and second protrusion 10*b* are easier to elastically deform in the protruding direction, second protrusion 10*b* is made smaller than first protrusion 10*a*, and consequently, second edge 11 serves to make up for the deficiency due to being hard to elastically deform in a direction opposite to diaphragm 3.

As a result, the difference between elastic deforming loads in up and down directions of combination 12 formed of damper 10 and second edge 11 is lowered, thereby suppressing the distortion of the speaker.

Naturally, in case first protrusion 10*a* is smaller than second protrusion 10*b*, in order to make up for deficiency in elasticity of first protrusion 10*a*, second edge 11 is protruded in a direction opposite to diaphragm 3 according to first protrusion 10*a*. In this way, same advantage can be obtained as well.

Consequently, the vertical excursion of diaphragm 3 is made generally symmetrical, and it is possible to reduce distortion in the speaker. Also, since first edge 4 is reduced in weight, the speaker is excellent in driving efficiency as a mid-range and a full-range speaker.

Thus, in a configuration such that damper 10 is connected to frame 5 via second edge 11, as described earlier, power linearity can be assured by corrugated damper 10 until the movable range of voice coil body 2 increases to a certain extent. And, when the movable range of voice coil body 2 exceeds the predetermined value, making it difficult to assure the linearity, the elasticity of second edge 11 will compensate for the deficiency in linearity. Accordingly, it is desirable to set Young's modulus of second edge 11 greater (stiffer) than Young's modulus of damper 10.

Also, damper 10 and second edge 11 are different from each other with respect to Young's modulus, and it is desirable to set the elasticity so that both of them individually function in accordance with the movable range of voice coil body 2. That is, between damper 10 and second edge 11, more specifically, in the connecting region between damper 10 and second edge 11, the individuality of both members can be assured by setting Young's modulus of the region greater (stiffer) than Young's modulus of damper 10 and second edge 11.

For setting Young's modulus of the connecting region between damper 10 and second edge 11 greater (stiffer) than Young's modulus of damper 10 and second edge 11, for example, a stiff bond such as acrylic bond is used for bonding second edge 11 to damper 10, or second edge 11 and damper 10 are integrated by insert mold to increase the thickness thereof, or a reinforcing material is affixed to the connecting region.

INDUSTRIAL APPLICABILITY

The present invention is able to reduce speaker distortion and also to improve the driving efficiency, and particularly, it is useful for a mid-range and a full-range speakers.

The invention claimed is:

1. A speaker comprising:

a frame;

a magnetic circuit supported by the frame;

a voice coil body disposed movably against a magnetic gap in the magnetic circuit;

a diaphragm having an outer rim connected to the frame via a first edge and an inner rim connected to the voice coil body; and a damper disposed closer to the magnetic circuit than the diaphragm, the damper having an inner rim connected to the voice coil body, wherein:

the damper has an outer rim connected to the frame via a second edge, the second edge has a protruding portion protruding toward the diaphragm or the opposite side thereof, the damper has such a structure that a first protrusion protruding toward the diaphragm and a second protrusion protruding in a direction opposite to the first protrusion are alternately repeated in a plurality of times, the first protrusion and the second protrusion are different in size, and the smaller protrusion out of the first and second protrusions protrudes in a same protruding direction as that of the second edge.

2. The speaker of claim 1, wherein Young's modulus of a combination formed of the damper and the second edge is greater than Young's modulus of the first edge.

3. The speaker of claim 2, wherein Young's modulus of the second edge is greater than Young's modulus of the damper.

4. The speaker of claim 2, wherein Young's modulus of a connecting portion between the damper and the second edge is greater than Young's modulus of the damper and the second edge.

5. The speaker of claim 1, wherein Young's modulus of the second edge is greater than Young's modulus of the damper.

6. The speaker of claim 5, wherein Young's modulus of a connecting portion between the damper and the second edge is greater than Young's modulus of the damper and the second edge.

7. The speaker of claim 1, wherein Young's modulus of a connecting portion between the damper and the second edge is greater than Young's modulus of the damper and the second edge.

8. The speaker of claim 1, wherein the outer rim of the damper is supported only by the second edge.

9. The speaker of claim 1, wherein the voice coil is connected to the frame only by the diaphragm and the first edge, and the damper and the second edge.

* * * * *

UNITED STATES PATENT AND TRADEMARK OFFICE

CERTIFICATE OF CORRECTION

PATENT NO. : 8,005,253 B2
APPLICATION NO. : 11/794953
DATED : August 23, 2011
INVENTOR(S) : Osamu Funahashi It is certified that error appears in the above-identified patent and that said Letters Patent is hereby corrected as shown below:

On the title page, in item (56) References Cited, U.S. Patent Documents, the fourth reference listed is incorrect. It currently reads 6,448,375 B1 9/2002 Hutt but should read 6,449,375 B1 9/2002 Hutt.

Signed and Sealed this
Tenth Day of January, 2012

David J. Kappos

David J. Kappos
*Director of the United States Patent and Trademark Office*